US008850721B2

(12) United States Patent
Long et al.

(10) Patent No.: US 8,850,721 B2
(45) Date of Patent: Oct. 7, 2014

(54) ARTICLE OF FOOTWEAR WITH ARCH MEMBER

(75) Inventors: Bradley S. Long, Portland, OR (US); James C. Meschter, Portland, OR (US); Benjamin A. Shaffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 943 days.

(21) Appl. No.: 12/712,474

(22) Filed: Feb. 25, 2010

(65) Prior Publication Data

US 2011/0203137 A1 Aug. 25, 2011

(51) Int. Cl.

| | |
|---|---|
| ***A43B 7/22*** | (2006.01) |
| ***A43C 11/00*** | (2006.01) |
| ***A43B 23/00*** | (2006.01) |
| ***A43B 13/22*** | (2006.01) |
| ***A43C 11/14*** | (2006.01) |
| ***A43B 5/12*** | (2006.01) |

(52) U.S. Cl.

CPC . *A43B 5/12* (2013.01); *A43C 11/14* (2013.01); *A43B 7/22* (2013.01)

USPC ..... 36/91; 36/50.1; 36/107; 36/72 R

(58) Field of Classification Search

CPC ..... A43B 7/1405; A43B 7/142; A43B 7/143; A43B 13/14

USPC ..... 36/107, 108, 146, 148–152, 91, 50.1, 36/8.3

See application file for complete search history.

(56) References Cited

U.S. PATENT DOCUMENTS

| | | | | |
|---|---|---|---|---|
| 892,152 | A * | 6/1908 | Harman | 36/72 R |
| 4,412,393 | A | 11/1983 | Terlizzi, Jr. et al. | |
| 4,453,996 | A | 6/1984 | Terlizzi, Jr. et al. | |
| 5,101,579 | A | 4/1992 | Terlizzi et al. | |
| 5,319,866 | A | 6/1994 | Foley et al. | |
| 5,566,478 | A | 10/1996 | Forrester | |
| 5,682,685 | A | 11/1997 | Terlizzi | |
| 5,845,420 | A * | 12/1998 | Buccianti et al. | 36/91 |
| 5,956,868 | A | 9/1999 | Stevens et al. | |
| 6,076,284 | A | 6/2000 | Terlizzi | |
| 6,401,366 | B2 * | 6/2002 | Foxen et al. | 36/91 |
| 6,588,124 | B2 | 7/2003 | Morrone | |
| 6,634,121 | B2 | 10/2003 | Sordi | |
| 6,708,426 | B2 | 3/2004 | Erickson et al. | |
| 6,772,541 | B1 * | 8/2004 | Ritter et al. | 36/88 |
| 7,094,213 | B1 * | 8/2006 | Cook | 602/65 |
| 7,337,558 | B2 * | 3/2008 | Terlizzi et al. | 36/8.3 |
| 7,673,396 | B2 | 3/2010 | Terlizzi et al. | |
| 7,685,740 | B2 * | 3/2010 | Sokolowski | 36/8.3 |

(Continued)

FOREIGN PATENT DOCUMENTS

| | | |
|---|---|---|
| CA | 2187830 | 4/1997 |
| EP | 0070003 | 1/1983 |

(Continued)

*Primary Examiner* — Khoa Huynh
*Assistant Examiner* — Timothy K Trieu
(74) *Attorney, Agent, or Firm* — Plumsea Law Group, LLC

(57) ABSTRACT

An article of footwear with a pair of arch members is disclosed. The arch members provide the only structural connection between a forefoot portion of a sole and a heel portion of the sole. In particular, the arch members provide a connection between a forefoot portion and a rearward portion of the heel portion of the sole.

20 Claims, 14 Drawing Sheets

(56) References Cited

U.S. PATENT DOCUMENTS

| | | | | |
|---|---|---|---|---|
| 8,112,909 | B2 * | 2/2012 | Kubo et al. | 36/107 |
| 8,122,909 | B2 * | 2/2012 | Tonkovich et al. | 137/833 |
| 2002/0078591 | A1 | 6/2002 | Morrone | |
| 2003/0029055 | A1 | 2/2003 | Morrone | |
| 2005/0138839 | A1 | 6/2005 | Terlizzi et al. | |
| 2005/0138848 | A1 | 6/2005 | Fullerton | |
| 2006/0196078 | A1 | 9/2006 | Terlizzi et al. | |
| 2006/0196079 | A1 | 9/2006 | Terlizzi et al. | |
| 2007/0107264 | A1 * | 5/2007 | Meschter et al. | 36/76 R |
| 2007/0107265 | A1 | 5/2007 | Mueller et al. | |
| 2007/0283597 | A1 * | 12/2007 | Logan | 36/91 |
| 2008/0010854 | A1 | 1/2008 | Sokolowski | |
| 2008/0110045 | A1 | 5/2008 | Terlizzi et al. | |

FOREIGN PATENT DOCUMENTS

| | | |
|---|---|---|
| EP | 0412031 | 2/1991 |
| EP | 0672362 | 9/1995 |
| JP | 3149001 | 6/1991 |
| JP | 8117001 | 5/1996 |

* cited by examiner

ARTICLE OF FOOTWEAR WITH ARCH MEMBER

BACKGROUND

The present invention relates to an article of footwear, and in particular to an article of footwear with an arch member.

Articles with support for an arch have been previously proposed. Foxen et al. (U.S. Pat. No. 6,401,366) teaches an athletic shoe with a stabilizing frame that allows the forefoot and heel portions of a sole to axially pivot along an axis of pronation while supporting the foot longitudinally. Foxen teaches a sole structure with a heel portion and a forefoot portion that are independent, separately formed structures. Foxen teaches an arch portion of the sole structure including a flexible light weight material, such as the material of the upper, to facilitate axial flexibility. Furthermore, Foxen teaches an article with a frame 55 that includes medial and lateral stabilizing members. The medial and lateral stabilizing members extend between the sole forefoot and heel portions, operably securing them to each other.

The related art lacks provisions that allow substantial bending between the forefoot and heel of a sole. There is a need in the art for a design that overcomes these shortcomings.

SUMMARY

The invention discloses an article of footwear with a pair of arch members. In one aspect, the invention provides an article of footwear, comprising: an upper; a sole, the sole further comprising a forefoot portion and a heel portion, the forefoot portion being spaced apart from the heel portion by a gap; the heel portion including a forward portion and a rearward portion, the forward portion being disposed closer to the forefoot portion than the rearward portion; an arch member including a first end portion, a second end portion and an intermediate portion disposed between the first end portion and the second end portion; and where the first end portion is attached to the forefoot portion of the sole and wherein the second end portion is attached to the rearward portion of the heel portion.

In another aspect, the arch member extends over a majority of the length of the article of footwear.

In another aspect, the arch member is constructed of a rigid material.

In another aspect, the arch member is configured to deform.

In another aspect, the arch member is configured to provide a structural connection between the forefoot portion and the heel portion.

In another aspect, the arch member is configured to hold the heel portion in suspension with respect to the forefoot portion.

In another aspect, the invention provides An article of footwear, comprising: an upper; a sole comprising a forefoot portion and a heel portion, the forefoot portion being spaced apart from the heel portion by a gap; an arch member including a first end portion, a second end portion and an intermediate portion disposed between the first end portion and the second end portion; the first end portion being attached to the forefoot portion of the sole and the second end portion being attached to the heel portion; and wherein the intermediate portion is disposed adjacent to a portion of the upper and where the intermediate portion is spaced apart from the upper.

In another aspect, the upper includes an ankle strap.

In another aspect, a portion of the ankle strap is disposed between the intermediate portion and the upper.

In another aspect, the intermediate portion is disposed over the gap.

In another aspect, the second end portion of the arch member is attached to a rearward portion of the heel portion.

In another aspect, the arch member is a medial arch member associated with a medial side of the article of footwear.

In another aspect, a lateral arch member is disposed on a lateral side of the article of footwear and wherein the lateral arch member cooperates with the medial arch member to provide a structural connection between the forefoot portion and the heel portion of the sole.

In another aspect, the invention provides an article of footwear, comprising: an upper; a sole comprising a forefoot portion and a heel portion, the forefoot portion being spaced apart from the heel portion by a gap; an arch member including a first end portion, a second end portion and an intermediate portion disposed between the first end portion and the second end portion; the first end portion being attached to the forefoot portion of the sole and the second end portion being attached to the heel portion; and where the distance between the first end portion and the second end portion substantially decreases as the sole is moved between a substantially flat position and a substantially curled position.

In another aspect, the substantially curled position is an en pointe position.

In another aspect, the arch member bends as the sole is moved between the substantially flat position and the substantially curled position.

In another aspect, the intermediate portion is disposed between the first end portion and the second end portion in a longitudinal direction.

In another aspect, the arch member has a bowed shape.

In another aspect, the arch member is configured to bend.

In another aspect, a portion of the arch member is spaced apart from the upper.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
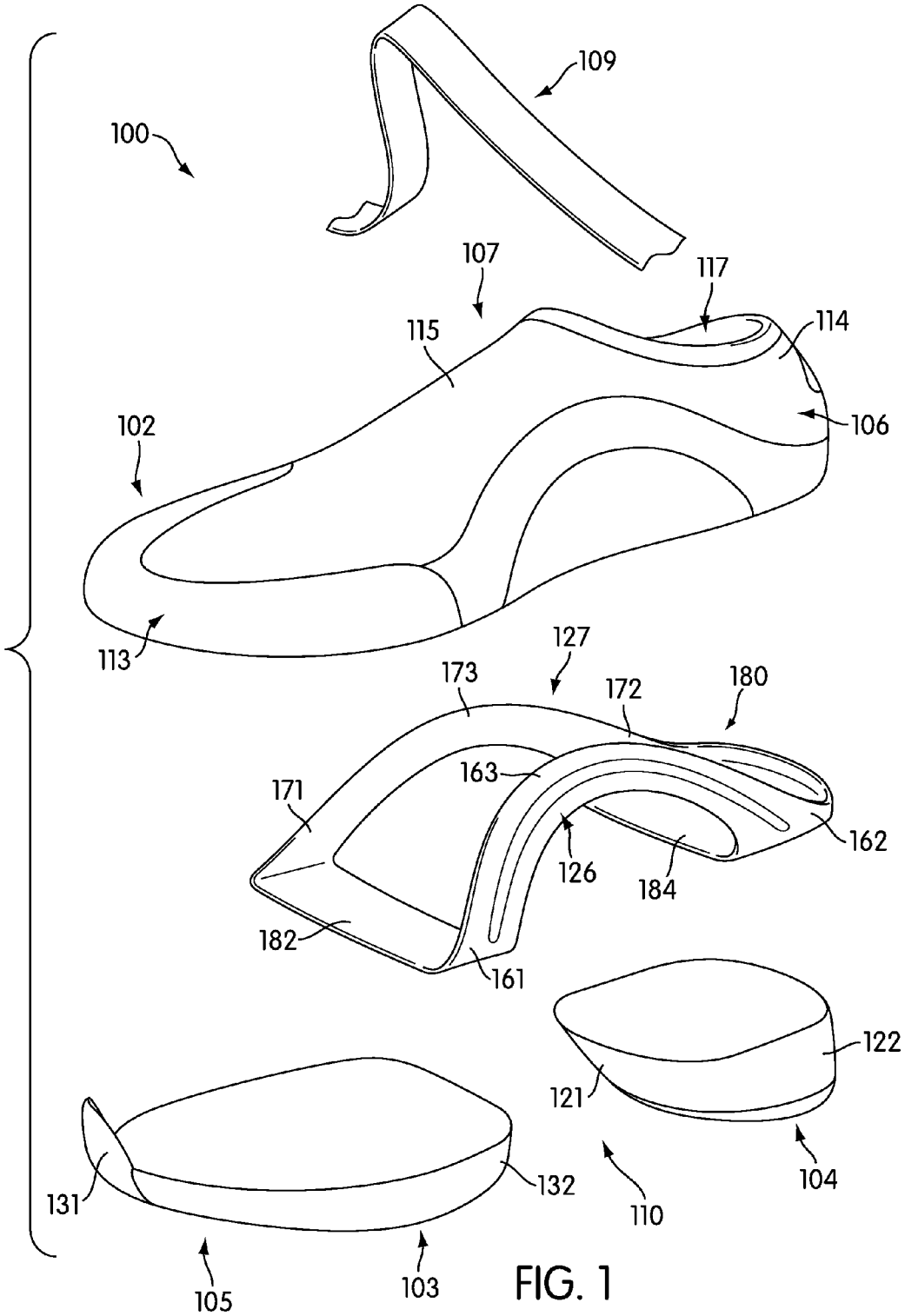
FIG. 1 is an exploded isometric view of an embodiment of an article of footwear.

FIG. 1 illustrates an exploded isometric view of an embodiment of article of footwear 100. For clarity, the following detailed description discusses an embodiment of article of footwear 100, in the form of a dance shoe, but it should be noted that the present invention could take the form of any article of footwear including, but not limited to, sneakers, soccer shoes, football shoes, rugby shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Article of footwear 100 includes upper 102. Generally, upper 102 may be any type of upper. In particular, upper 102 could have any design, shape, size and/or color. For example, in embodiments where upper 102 is associated with a dance shoe, upper 102 could be a soft bootie that is configured to enable flexing and movement of a foot.

Typically, upper 102 is configured to receive a foot of a wearer. In some embodiments, upper 102 includes entry hole 117 configured to receive a foot of a wearer. With this arrangement, entry hole 117 can allow a foot to be inserted into an interior of upper 102.

Upper 102 may also include medial portion 106. Also, upper 102 may include lateral portion 107 disposed opposite medial portion 106. Medial portion 106 may be associated with an inside of a foot. Similarly, lateral portion 107 may be associated with an outside of a foot.

Upper 102 may include toe portion 113 that is associated with the toes of a foot. In embodiments where upper 102 is associated with a dance shoe, toe portion 113 may be configured with provisions for allowing a wearer to rise on toe portion 113 in an en pointe position. For example, in some cases, toe portion 113 may be associated with provisions including, but not limited to, pads, a toe bumper and other provisions.

Upper 102 also includes heel portion 114 that is associated with a heel of a foot. In addition, upper 102 also includes arch portion 115 that is disposed between toe portion 113 and heel portion 114. With this arrangement, arch portion 115 can be associated with a midfoot, including an arch of the foot and a top of the foot.

In some embodiments, article of footwear 100 may include a fastening system configured to tighten upper 102. Generally, article of footwear 100 could be associated with any type of fastening system including, but not limited to laces, straps, zippers, hook and loop fasteners, as well as other types of fastening systems. In one embodiment, article of footwear 100 includes a fastening system with a strap.

Article of footwear 100 may be associated with strap 109. Generally, strap 109 may be disposed on any portion of upper 102 to fasten upper 102 to a foot. In some cases, strap 109 may wrap around an ankle of a wearer adjacent to entry hole 117. In other cases, strap 109 may wrap around arch portion 115 of upper 102. In still other cases, strap 109 may wrap around arch portion 115 as well as an ankle of a wearer.

Strap 109 may be configured with any length necessary to fasten upper 102 to a foot. For example, in some embodiments, strap 109 may be configured with a length that allows strap 109 to wrap around arch portion 115 as well as around an ankle of a wearer of article 100. With this arrangement, end portions of strap 109 may be fastened around an ankle of a wearer.

In some embodiments, upper 102 may be associated with sole 105. Sole 105 further comprises forefoot portion 103 and heel portion 104. Forefoot portion 103 may be associated with a forefoot of a foot. Likewise, heel portion 104 may be associated with a heel of a foot.

Heel portion 104 includes forward portion 121 and rearward portion 122. Forward portion 121 is disposed closer to forefoot portion 103 than rearward portion 122. In addition, forefoot portion 103 also includes forward portion 131 and rearward portion 132. Forward portion 131 may be associated with toe portion 113 of upper 102. Likewise, rearward portion 132 may be disposed closer to heel portion 114 of upper 102.

Sole 105 also includes gap 110 disposed between forefoot portion 103 and heel portion 104. In particular, gap 110 is disposed between rearward portion 132 of forefoot portion 103 and forward portion 121 of heel portion 104. Furthermore, gap 110 is disposed below arch portion 115 of upper 102. With gap 110 disposed between forefoot portion 103 and heel portion 104, sole 105 may enable articulation and relative movement between forefoot portion 103 and heel portion 104.

Forefoot portion 103 and heel portion 104 of sole 105 may comprise multiple components. In some cases, forefoot portion 103 and/or heel portion 104 may include an outsole. In other cases, forefoot portion 103 and/or heel portion 104 may include a midsole. In still other cases, forefoot portion 103 and/or heel portion 104 may include an insole. In one embodiment, forefoot portion 103 and/or heel portion 104 of sole 105 may include an outsole, a midsole and an insole.

An article of footwear with a sole comprising separate forefoot and heel portions may be configured with one or more structures that connect the forefoot and heel portions of the sole. With a structural connection between the forefoot and heel portions of the sole, the article can allow some independent movement between the forefoot and heel portions of the sole while still providing some structural support that may limit stress on an arch portion of a foot. For example, if a wearer rises en pointe, a rigid or semi-rigid structural connection between the forefoot and heel portions of the sole may limit the amount of stress experienced by a foot. In some embodiments, an article of footwear can include an arch member that provides a structural connection between the forefoot and heel portions of the sole. In one embodiment, an article of footwear can include a pair of arch members that are configured as structural connections between the forefoot portion and heel portion of the sole.

Article of footwear 100 is configured with medial arch member 126 and lateral arch member 127. Medial arch member 126 includes first end portion 161 and second end portion 162, with second end portion 162 disposed opposite first end portion 161. In addition, medial arch member 126 includes intermediate portion 163 disposed between first end portion 161 and second end portion 162. In a similar manner, lateral arch member 127 includes first end portion 171 and second end portion 172, with second end portion 172 disposed opposite first end portion 171. Likewise, lateral arch member 127 includes intermediate portion 173 disposed between first end portion 171 and second end portion 172.

Typically, medial arch member 126 and lateral arch member 127 have arch-like, or bowed, shapes. In other words, intermediate portion 163 of medial arch member 126 is generally rounded between first end portion 161 and second end portion 162. Furthermore, intermediate portion 163 is disposed between first end portion 161 and second end portion 162 in a longitudinal direction. The term "longitudinal direction" as used throughout this detailed description and in the claims refers to a direction associated with a length of article 100. Similarly, intermediate portion 173 of lateral arch member 127 is generally rounded between first end portion 171 and second end portion 172. Also, intermediate portion 173 is disposed between first end portion 171 and second end portion 172 in a longitudinal direction. In one embodiment, intermediate portion 163 and intermediate portion 173 may be configured with substantially symmetrical curves between respective end portions of medial arch member 126 and lateral arch member 127.

In some embodiments, medial arch member 126 and lateral arch member 127 may be disconnected from one another. In other embodiments, medial arch member 126 and lateral arch member 127 may be connected to one another. For example, in the current embodiment, first end portion 161 of medial arch member 126 may be connected to first end portion 171 of lateral arch member 127 by first connecting portion 182. Likewise, in the current embodiment, second end portion 162 of medial arch member 126 may be connected to second end portion 172 of lateral arch member 127 by second connecting portion 184. With this arrangement, medial arch member 126 and lateral arch member 127 may comprise a single arch member 180.

Generally, each component of article of footwear 100 may be constructed of any material. Forefoot portion 103 and heel portion 104 of sole 105 may be constructed from any suitable material, including but not limited to elastomers, siloxanes, natural rubber, other synthetic rubbers, aluminum, steel, natural leather, synthetic leather, or plastics. Also, upper 102 may be made from any suitable material, including but not limited to, neoprene, nylon, natural leather, synthetic leather, natural rubber, or synthetic rubber. In addition, medial arch member 126 and lateral arch member 127 may be constructed from any suitable material, including but not limited to, natural rubber, other synthetic rubbers, textiles, metals or plastics. In one embodiment, medial arch member 126 and lateral arch member 127 may each be constructed of polyester block amide (PEBAX).

Figure 2:
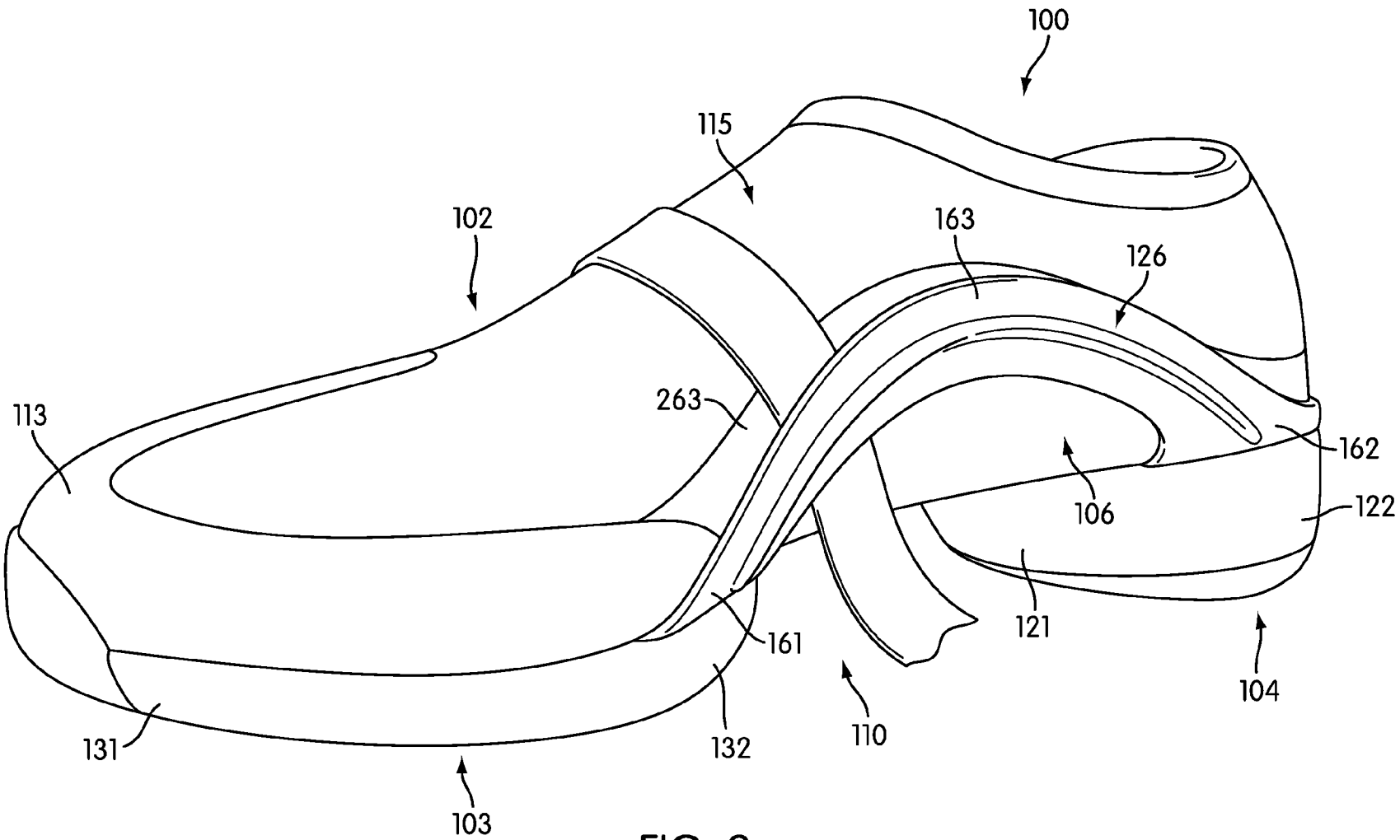
FIG. 2 is a side view of an embodiment of a medial portion of an article of footwear.
Figure 3:
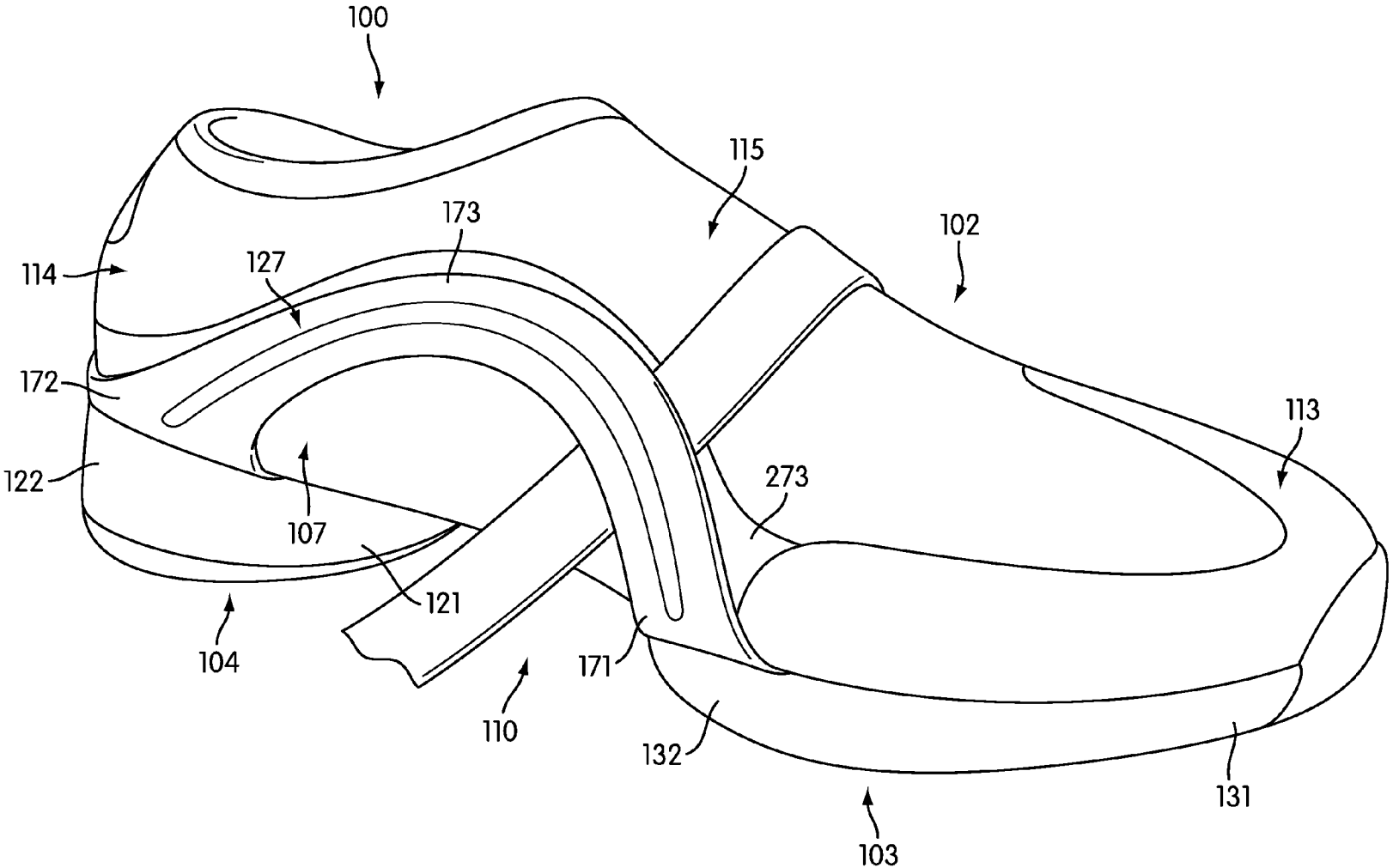
FIG. 3 is a side view of an embodiment of a lateral portion of an article of footwear.

FIGS. 2 and 3 illustrate assembled medial and lateral views of an embodiment of article 100. In particular, FIG. 2 is a medial side view of an embodiment of article 100 and FIG. 3 is a lateral side view of an embodiment of article 100. This allows the attachment of medial arch member 126 and lateral arch member 127 to be clearly visible in FIGS. 2 and 3.

As previously discussed, medial arch member 126 and lateral arch member 127 are the sole structural connections between forefoot portion 103 and heel portion 104. Generally, medial arch member 126 and lateral arch member 127 may be attached to any portion of forefoot portion 103 and heel portion 104 in order to connect forefoot portion 103 to heel portion 104. In some embodiments, medial arch member 126 and lateral arch member 127 may be attached to forward portion 131 of forefoot portion 103 and rearward portion 122 of heel portion 104 on medial side and lateral side, respectively, of sole 105. In other embodiments, medial arch member 126 and lateral arch member 127 may be attached to rearward portion 132 of forefoot portion 103 and rearward portion 122 of heel portion 104 on medial side and lateral side, respectively, of sole 105.

Referring to FIG. 2, first end portion 161 of medial arch member 126 is attached to rearward portion 132 of forefoot portion 103. Similarly, second end portion 162 is attached to rearward portion 122 of heel portion 104. With this configuration, medial arch member 126 may extend between, and connect, forefoot portion 103 and heel portion 104.

In a similar manner, first end portion 171 of lateral arch member 127 is attached to rearward portion 132 of forefoot portion 103, as seen in FIG. 3. Likewise, second end portion 172 is attached to rearward portion 122 of heel portion 104. This arrangement allows lateral arch member 127 to extend between, and connect, forefoot portion 103 and heel portion 104.

Generally, end portions of medial arch member 126 and lateral arch member 127 may be attached to forefoot portion 103 and heel portion 104 in any manner known in the art. In some embodiments, end portions of medial arch member 126 and lateral arch member 127 may be attached to forefoot portion 103 and heel portion 104 with adhesives. In other embodiments, end portions of medial arch member 126 and lateral arch member 127 may be attached to forefoot portion 103 and heel portion 104 through stitching.

After attaching medial arch member 126 and lateral arch member 127 to forefoot portion 103 and heel portion 104, article 100 may be assembled by attaching upper 102 to forefoot portion 103 and heel portion 104. By attaching upper 102 to forefoot portion 103 and heel portion 104, a bottom portion of arch portion 115 is disposed between forefoot portion 103 and heel portion 104. With this arrangement, arch portion 115 may be disposed above gap 110 of sole 105. As previously discussed, this arrangement allows increased articulation and some independent movement between forefoot portion 103 and heel portion 104.

With the assembly of article 100, medial arch member 126 may be disposed adjacent to medial portion 106 of upper 102. In particular, intermediate portion 163 may be disposed adjacent to medial portion 106 of upper 102 as seen in FIG. 2. In a similar manner, intermediate portion 173 of lateral arch member 127 may be disposed adjacent to lateral portion 107 of upper 102 as seen in FIG. 3.

Although intermediate portion 163 and intermediate 173 are disposed adjacent to upper 102, it should be understood that intermediate portion 163 and intermediate portion 173 are spaced apart from upper 102. Generally, this can be achieved by only attaching medial arch member 126 to forefoot portion 103 at first end portion 161 and to heel portion 104 at second end portion 162. Likewise, lateral arch member 127 is only attached to forefoot portion 103 at first end portion 171 and to heel portion 104 at second end portion 172. This arrangement allows some independent movement of upper 102 and medial arch member 126 and lateral arch member 127 as article 100 flexes and/or bends.

In some embodiments, upper 102 may include provisions to limit potential rubbing of medial arch member 126 and lateral arch member 127 against a foot disposed within upper 102. In some cases, upper 102 may be configured with material or padding where medial arch member 126 and lateral arch member 127 may rub against a foot disposed within upper 102. In one embodiment, upper 102 includes material configured in an arch-like shape to limit contact between a foot within upper 102 and medial arch member 126 and lateral arch member 127.

Referring to FIGS. 2 and 3, upper 102 includes medial arch stripe 263 and lateral arch stripe 273. Medial arch stripe 263 extends between a forefoot portion of upper 102 and heel portion 114 of upper 102 in a substantially similar shape as medial arch member 126. Similarly, lateral arch stripe 273 extends between a forefoot portion of upper 102 and heel portion 114 in a substantially similar shape as lateral arch member 127. With this arrangement, medial arch stripe 263 and lateral arch stripe 273 may be disposed between medial arch member 126 and lateral arch member 127, respectively, and a foot disposed within upper 102. This arrangement allows medial arch stripe 263 and lateral arch stripe 273 to limit potential rubbing of medial arch member 126 and lateral arch member 127, respectively, on a foot disposed within upper 102.

In some embodiments, forefoot portion 103 and/or heel portion 104 of sole 105 may be configured with an outsole pattern or sole treatments, including but not limited to, tread elements, reinforcement elements or marking elements. In some cases, forefoot portion 103 and/or heel portion 104 may include portions to increase traction with a ground surface. In other cases, forefoot portion 103 and/or heel portion 104 may include portions constructed from a reduced friction material that decrease traction with a ground surface to enable sliding and/or spinning.

Figure 4:
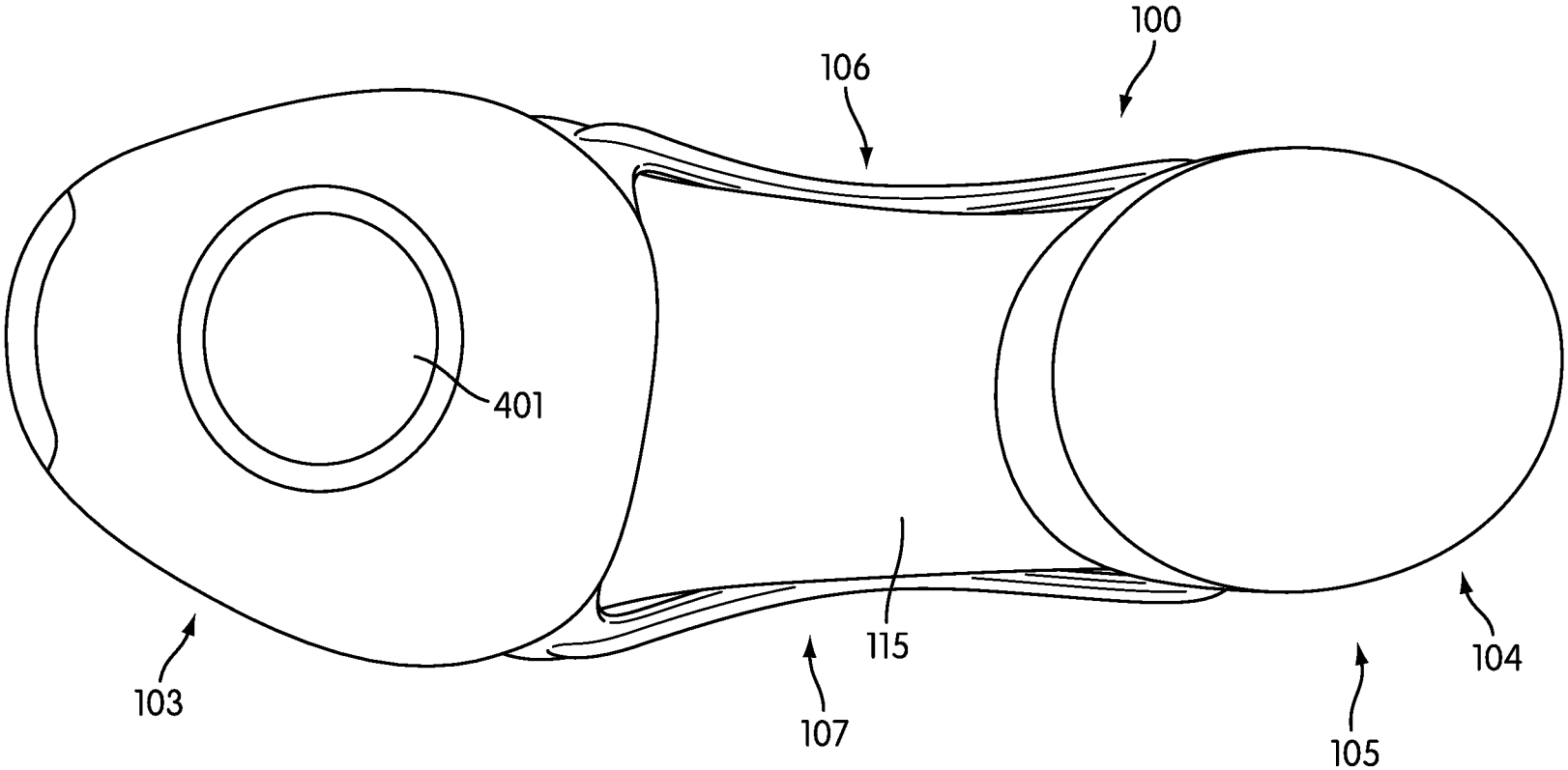
FIG. 4 is a bottom view of an embodiment of an article of footwear.

Referring to FIG. 4, forefoot portion 103 includes pivot portion 401. In some embodiments, pivot portion 401 may be disposed centrally on forefoot portion 103. In other embodiments, pivot portion 401 may be disposed on a periphery of forefoot portion 103. Furthermore, pivot portion 401 may be flush, recessed or raised with respect to forefoot portion 103. In one embodiment, pivot portion 401 may be disposed centrally and flush with forefoot portion 103.

Generally, pivot portion 401 may be configured in any shape, including but not limited to, circular shapes, rectangular shapes, square shapes, geometric shapes, regular shapes as well as irregular shapes. In one embodiment, pivot portion 401 comprises a substantially circular shape.

In some embodiments, pivot portion 401 comprises a reduced friction material. This material enables pivot portion 401 to slide or spin over a ground surface with greater ease than the remaining portion of forefoot portion 103. With this arrangement, pivot portion 401 may allow a wearer of article 100 to spin or slide with greater ease.

Figure 5:
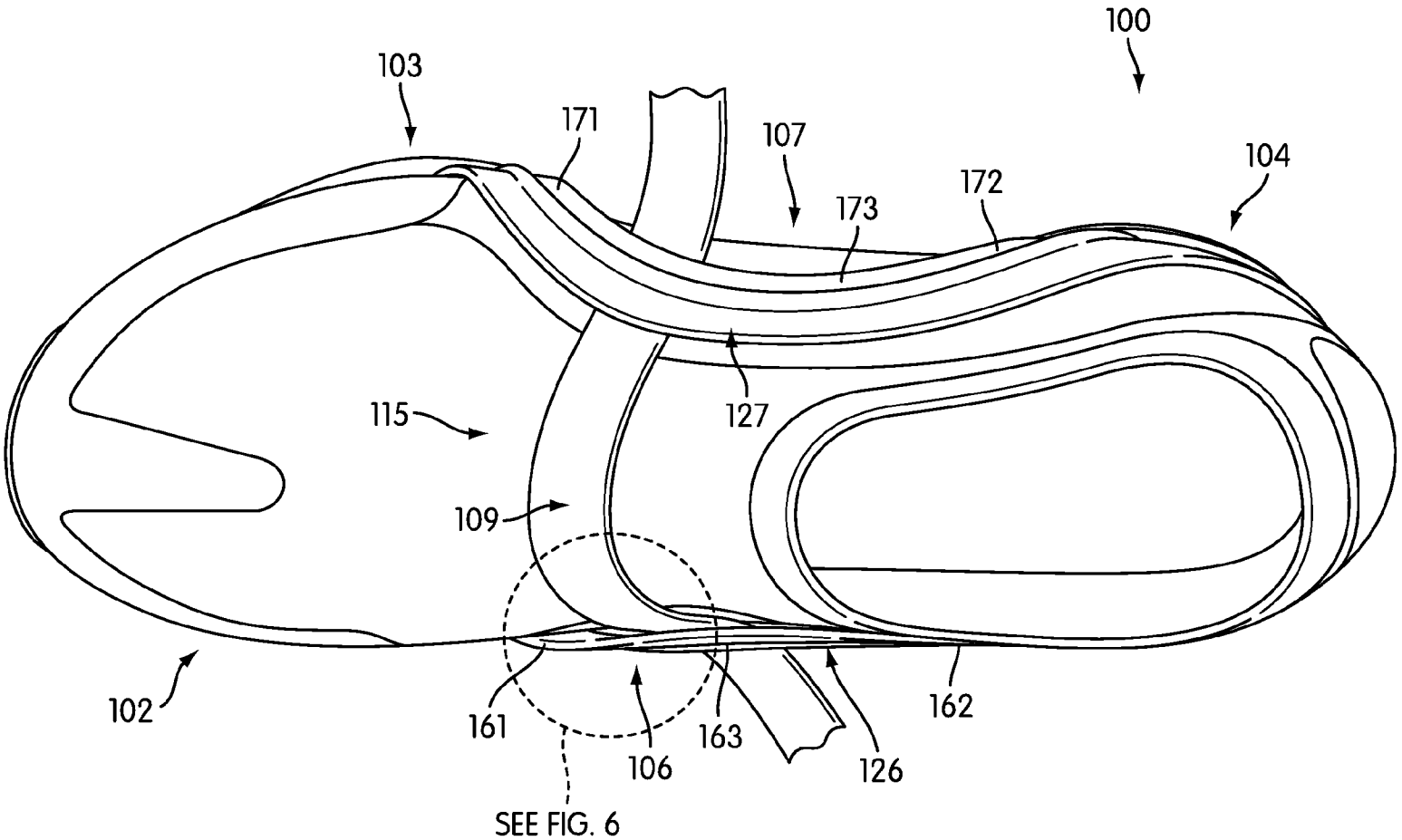
FIG. 5 is a top-down view of an embodiment of an article of footwear.

FIG. 5 is a top down view of an embodiment of article 100. In particular, the configuration of strap 109 with medial arch member 126 and lateral arch member 127 may be clearly visible in FIG. 5. It should be understood, however, that in other embodiments, strap 109 may be configured in a different manner. Furthermore, in embodiments with other types of fastening systems, a fastening system may be configured in a different manner with a medial arch member and a lateral arch member.

Figure 6:
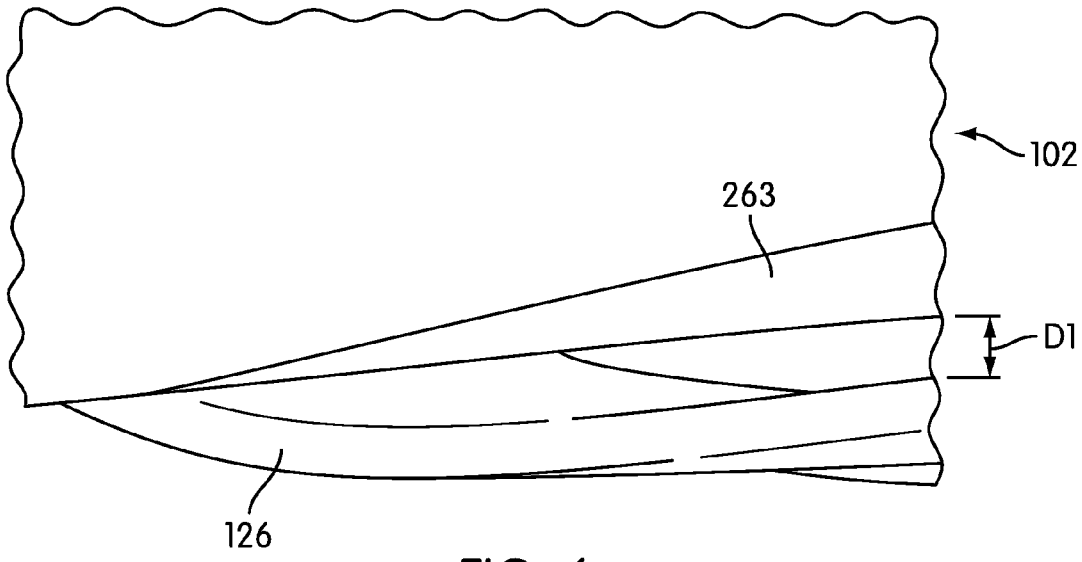
FIG. 6 is an enlarged view of an embodiment of the spacing between an arch member and an upper.

As previously discussed, intermediate portion 163 of medial arch member 126 and intermediate portion 173 of lateral arch member 127 are spaced apart from upper 102. Generally, intermediate portion 163 and intermediate portion 173 may be spaced apart any distance from upper 102. In one embodiment, lateral arch member 127 may be spaced apart distance D1 from upper 102 as illustrated in an enlarged view of a portion of medial arch member 126 and upper 102 in FIG. 6. It should be understood that lateral arch member 127 may be spaced apart a substantially similar distance from upper 102. With this arrangement, medial arch member 126 and lateral arch member 127 may be configured to move independently of upper 102.

With medial arch member 126 and lateral arch member 127 spaced apart from upper 102, a fastening system may be configured to fasten upper 102 to a foot without fastening medial arch member 126 and lateral arch member 127 to the foot. For example, in some embodiments, strap 109 may wrap around arch portion 115 of upper 102 in order to fasten upper 102 to a foot. In some cases, strap 109 may be threaded between upper 102 and medial arch member 126 as well as between upper 102 and lateral arch member 127 when strap 109 wraps around arch portion 115. This allows strap 109 to fasten arch portion 115 to a foot without fastening medial arch member 126 and lateral arch member 127 to the foot. With this arrangement, strap 109 may provide a better fit of upper 102 to a foot when fastening upper 102.

Figure 7:
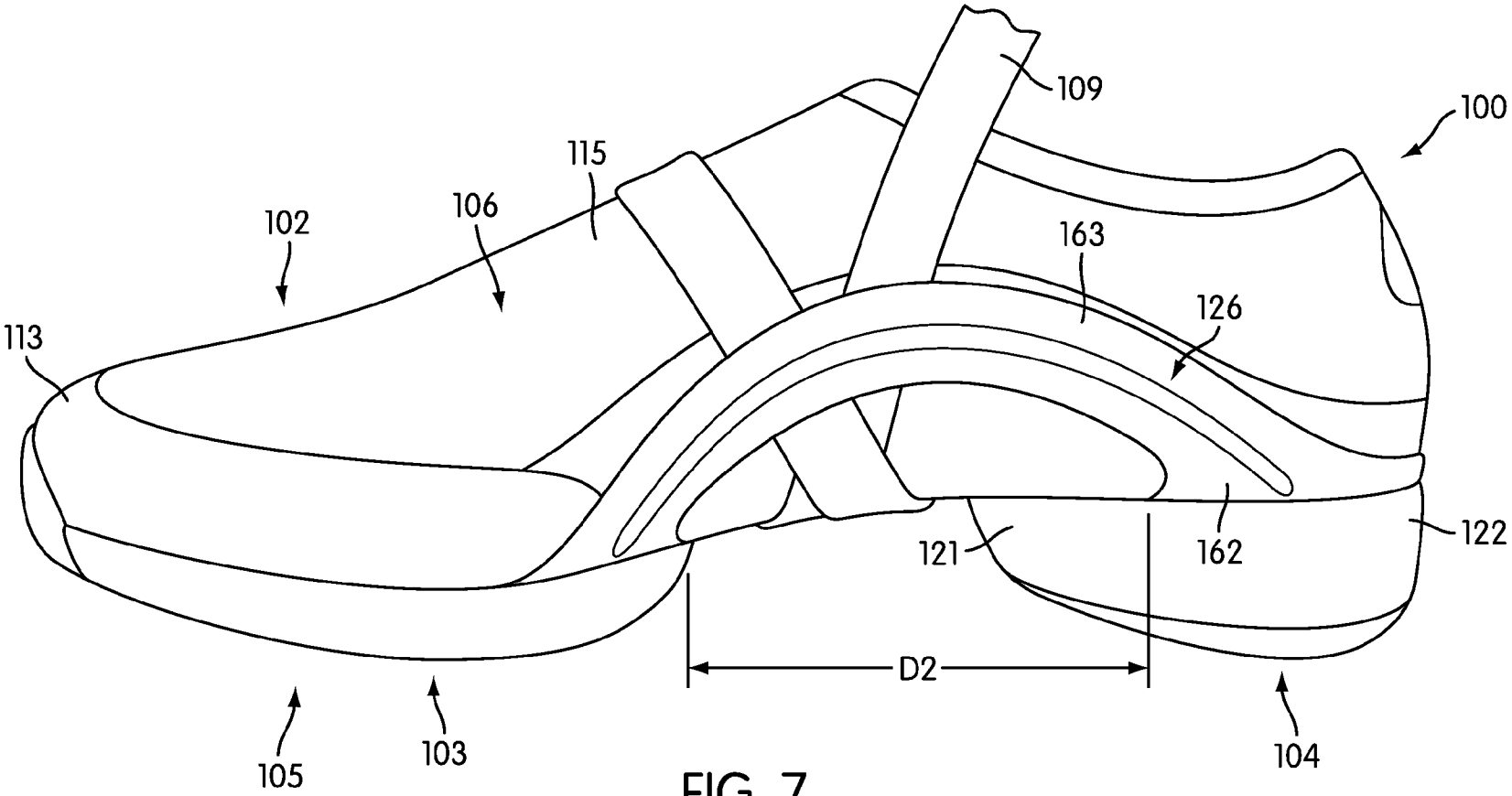
FIG. 7 is a side view of an embodiment of an article of footwear in a substantially flat position.
Figure 8:
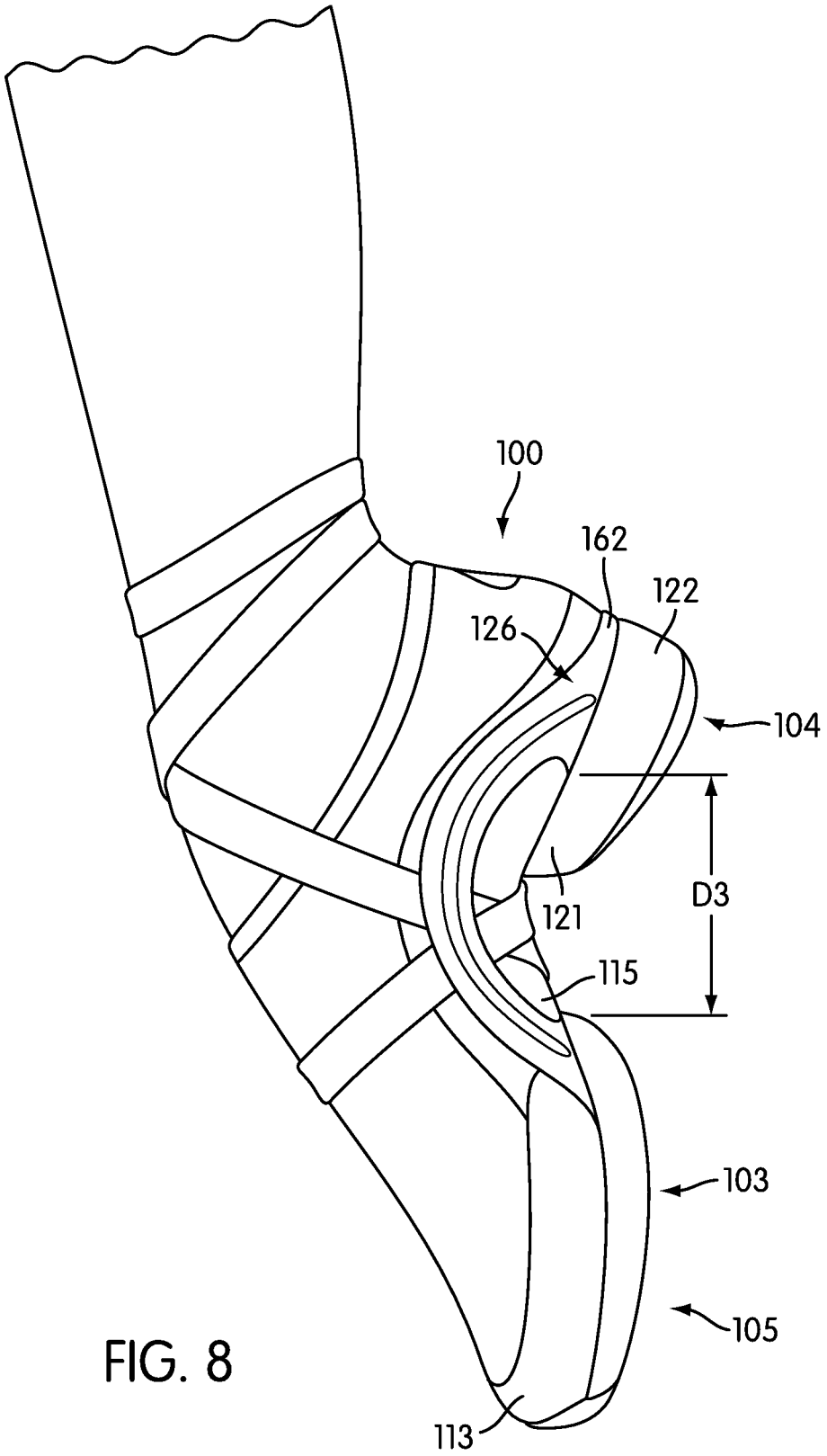
FIG. 8 is a side view of an embodiment of an article of footwear in a substantially curled position.
Figure 9:
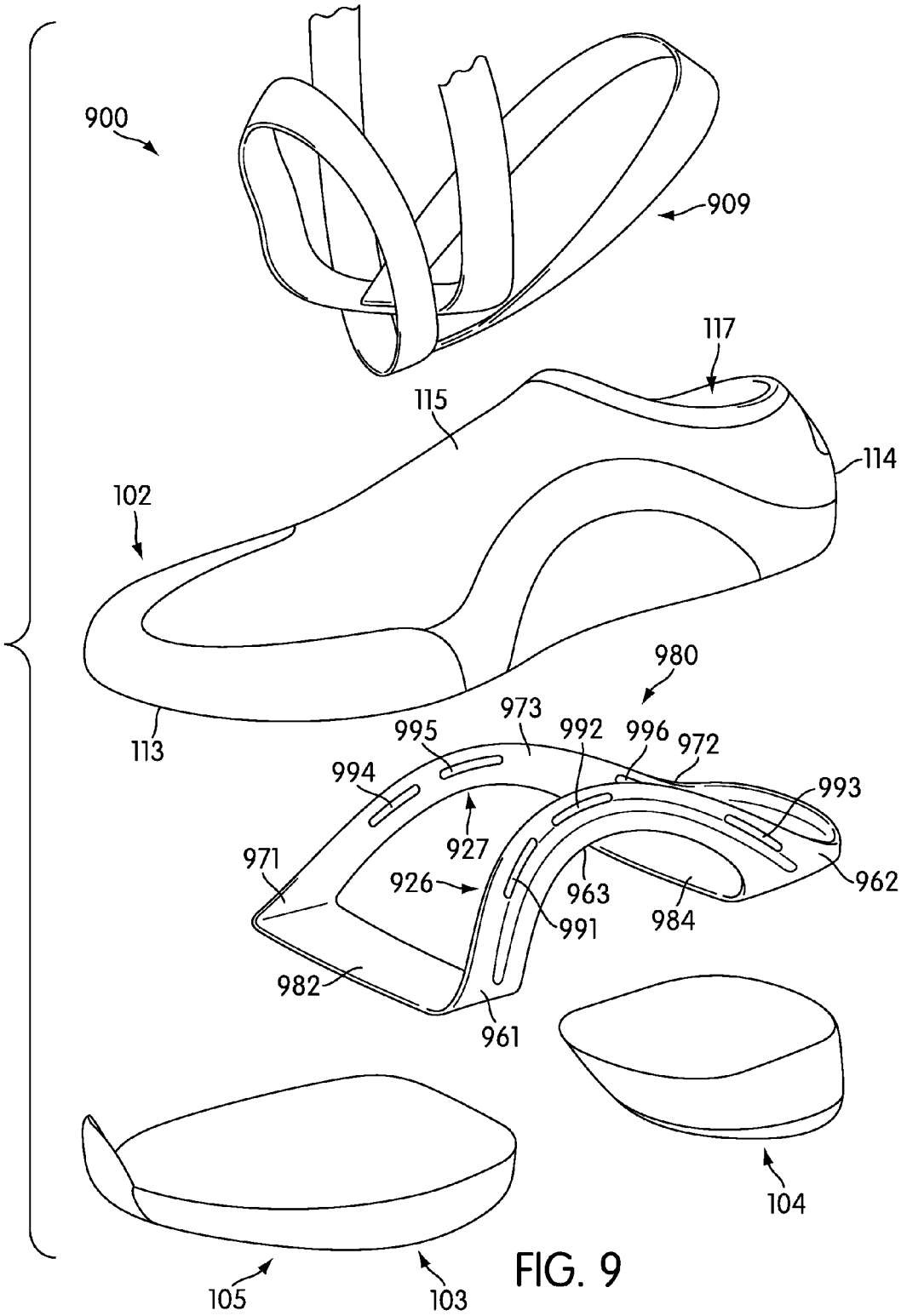
FIG. 9 is an exploded isometric view of an embodiment of an article of footwear.
Figure 10:
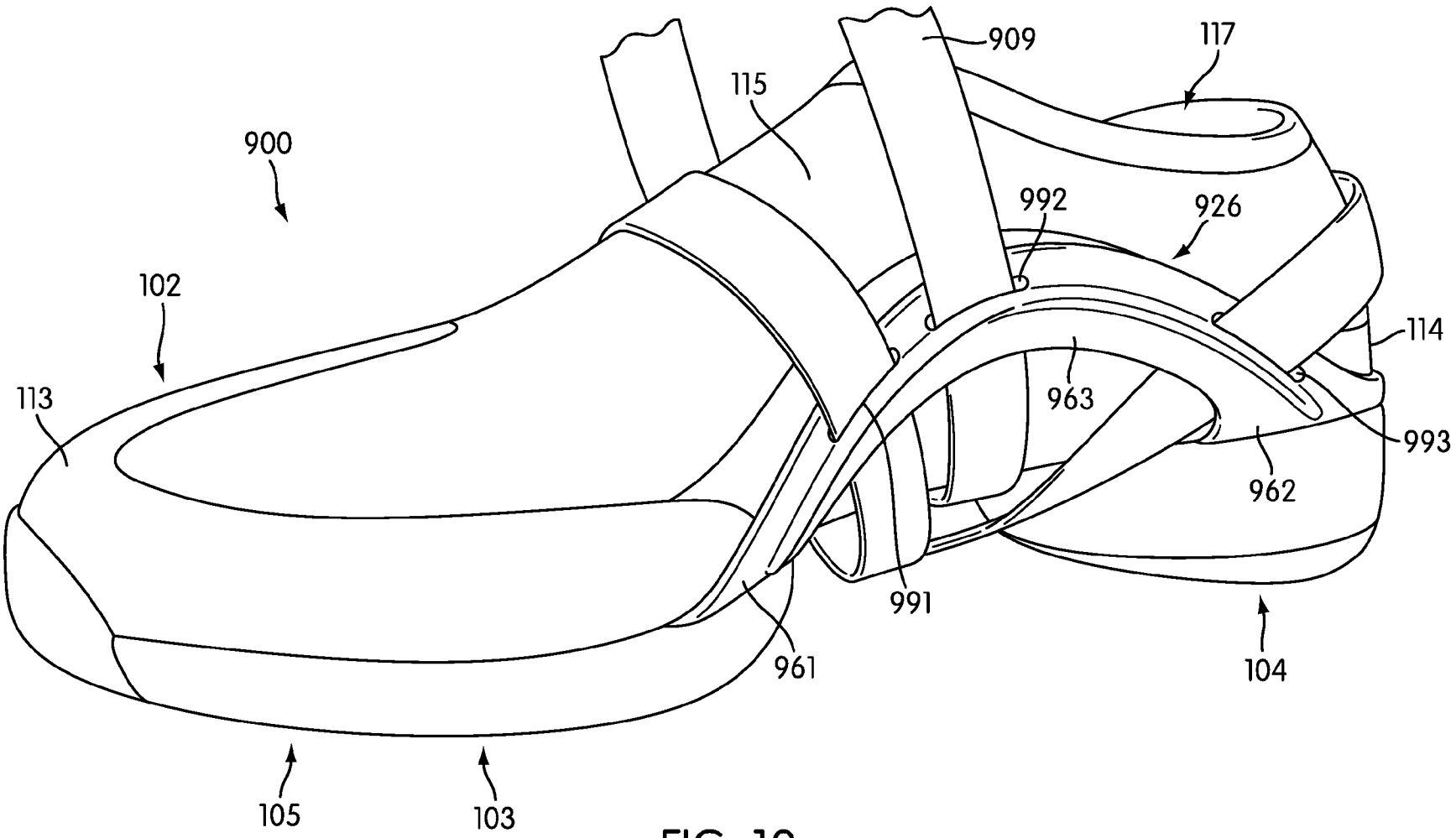
FIG. 10 is an isometric view of an embodiment of an article of footwear.
Figure 11:
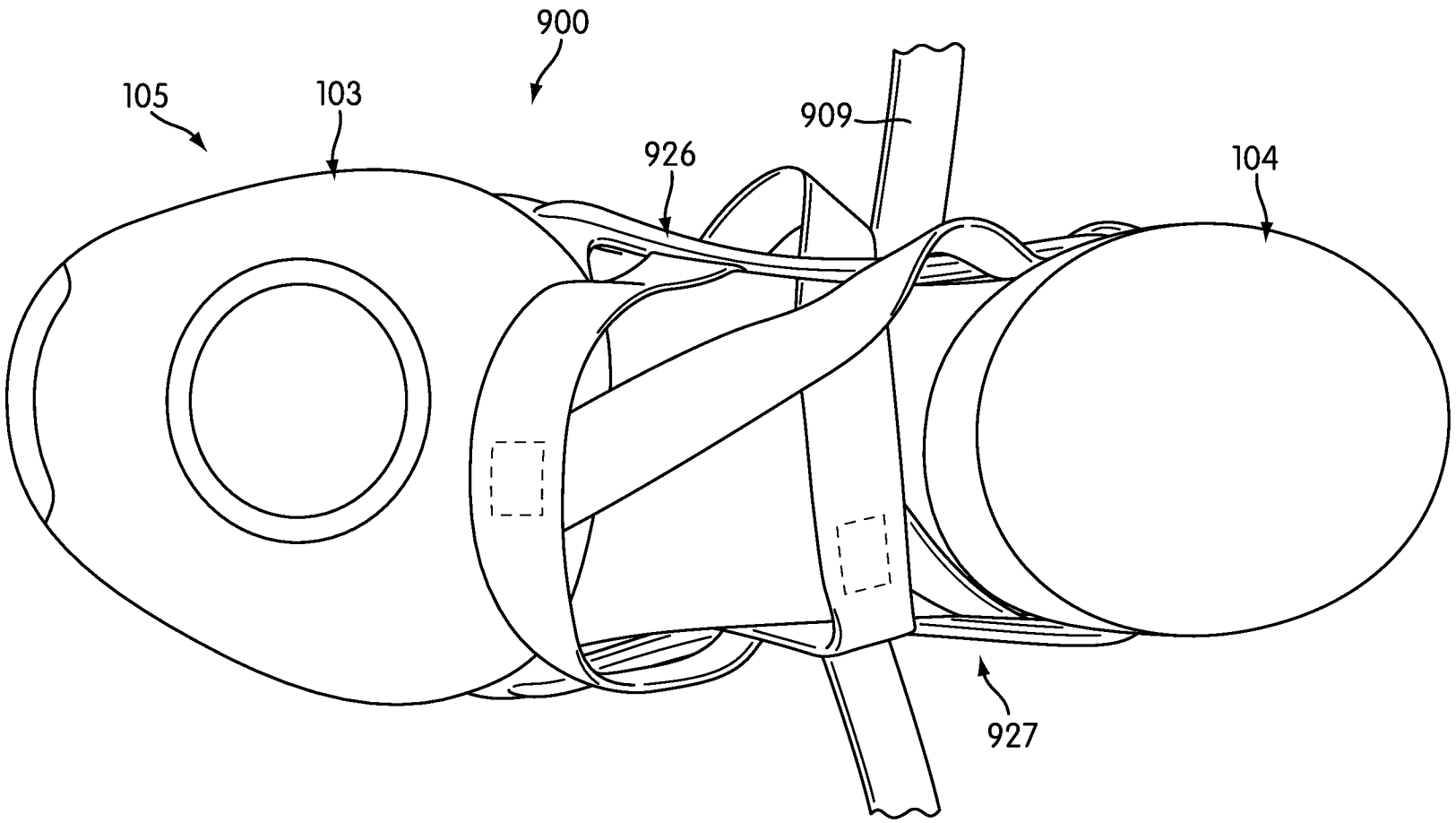
FIG. 11 is a bottom view of an embodiment of an article of footwear.
Figure 12:
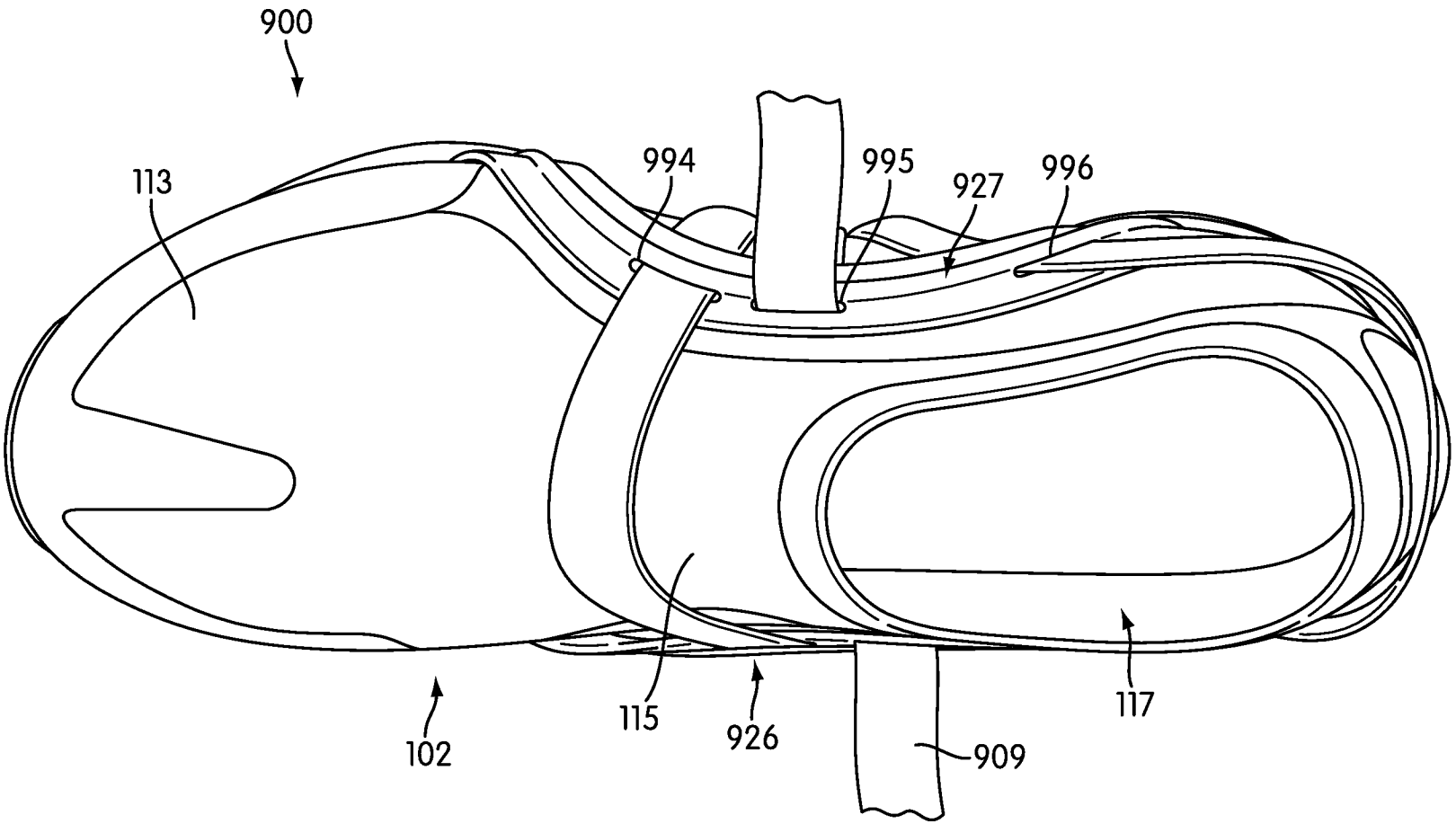
FIG. 12 is a top view of an embodiment of an article of footwear.

FIGS. 7 and 8 illustrate side views of an embodiment of article 100 with sole 105 configured in a substantially flat position and a substantially curled position, respectively. Typically, sole 105 may be in a substantially flat position as a wearer of article 100 stands on a ground surface. Furthermore, in some cases, sole 105 may be configured in a substantially curled position when a wearer of article 100 rises to balance on toe portion 113 in an en pointe position.

Referring to FIG. 7, first end portion 161 and second end portion 162 of medial arch member 126 may be spaced apart distance D2 when sole 105 is in a substantially flat position. Although lateral arch member 127 is not illustrated in FIG. 7, it should be understood that first end portion 171 and second end portion 172 of lateral arch member 127, as shown in FIG. 3, may be spaced apart a distance substantially similar to distance D2.

As sole 105 moves to a substantially curled position, medial arch member 126 and lateral arch member 127 bend to allow forefoot portion 103 and heel portion 104 to move closer together. By providing a structural connection between forefoot portion 103 and heel portion 104, medial arch member 126 and lateral arch member 127 also support an arch portion of a foot when sole 105 moves to a substantially curled position. In particular, medial arch member 126 and lateral arch member 127 may provide greater support to an arch portion of a foot because second end portion 162 and second end portion 172, not visible in this Figure, are attached to rearward portion 122. By attaching at rearward portion 122, medial arch member 126 and lateral arch member 127 extend over a greater range of sole 105. With this configuration, medial arch member 126 and lateral arch member 127 may provide greater support to an arch of a foot as sole 105 moves to a substantially curled position.

Referring to FIG. 8, as sole 105 moves to a substantially curled position, medial arch member 126 bends so that first end portion 161 and second end portion 162 move closer to each other. In particular, first end portion161 and second end portion 162 are spaced apart distance D3 when sole 105 is in a substantially curled position. Distance D3 is less than distance D2, separating first end portion 161 and second end portion 162, when sole 105 is in a substantially flat position. With this arrangement, medial arch member 126 and lateral arch member 127 may allow independent movement of forefoot portion 103 and heel portion 104 while providing support to an arch portion of a foot by structurally connecting forefoot portion 103 and heel portion 104.

FIGS. 9 through 14 illustrate another embodiment of an article of footwear including an arch member. Article of footwear 900 can include substantially similar components to article of footwear 100 discussed above. In particular, article of footwear 900 may include upper 102 and sole 105 in a similar manner to article of footwear 100.

Article of footwear 900 may be associated with strap 909. Generally, strap 909 may be disposed on any portion of upper 102 to fasten upper 102 to a foot. In some cases, strap 909 may wrap around an ankle of a wearer adjacent to entry hole 117. In other cases, strap 909 may wrap around arch portion 115 of upper 102. In other cases, strap 909 may wrap around heel portion 114 of upper 102. In still other cases, strap 909 may wrap around arch portion 115, heel portion 114 as well as an ankle of a wearer.

Strap 909 may be configured with any length necessary to fasten upper 102 to a foot. For example, in some embodiments, strap 909 may be configured with a length that allows strap 909 to wrap around arch portion 115 as well as around an ankle of a wearer of article 900. In an exemplary embodiment, strap 909 may be configured with a length that allows strap 909 to wrap around arch portion 115, heel portion 114 as well as the angle of a wearer.

Article of footwear 900 can also include one or more arch members that provide structural connections between forefoot portion 103 and heel portion 104 of sole 105. In one embodiment, article of footwear 900 can include a pair of arch members that are configured as structural connections between forefoot portion 103 and heel portion 104 of sole 105.

In the current embodiment, article of footwear 900 is configured with medial arch member 926 and lateral arch member 927. Medial arch member 926 includes first end portion 961 and second end portion 962, with second end portion 962 disposed opposite first end portion 961. In addition, medial arch member 926 includes intermediate portion 963 disposed between first end portion 961 and second end portion 962. In a similar manner, lateral arch member 927 includes first end portion 971 and second end portion 972, with second end portion 972 disposed opposite first end portion 971. Likewise, lateral arch member 927 includes intermediate portion 973 disposed between first end portion 971 and second end portion 972.

Typically, medial arch member 926 and lateral arch member 927 have arch-like, or bowed, shapes. In other words, intermediate portion 963 of medial arch member 926 is generally rounded between first end portion 961 and second end portion 962. Furthermore, intermediate portion 963 is disposed between first end portion 961 and second end portion 962 in a longitudinal direction. The term "longitudinal direction" as used throughout this detailed description and in the claims refers to a direction associated with a length of article 900. Similarly, intermediate portion 973 of lateral arch member 927 is generally rounded between first end portion 971 and second end portion 972. Also, intermediate portion 973 is disposed between first end portion 971 and second end portion 972 in a longitudinal direction. In one embodiment, intermediate portion 963 and intermediate portion 973 may be configured with substantially symmetrical curves between respective end portions of medial arch member 926 and lateral arch member 927.

In some embodiments, medial arch member 926 and lateral arch member 927 may be disconnected from one another. In other embodiments, medial arch member 926 and lateral arch member 927 may be connected to one another. For example, in the current embodiment, first end portion 961 of medial arch member 926 may be connected to first end portion 971 of lateral arch member 927 by first connecting portion 982. Likewise, in the current embodiment, second end portion 962 of medial arch member 926 may be connected to second end portion 972 of lateral arch member 927 by second connecting portion 984. With this arrangement, medial arch member 926 and lateral arch member 927 may comprise a single arch member 980.

An article of footwear can include provisions for tightening an arch member against a foot. In some cases, an arch member can be provided with provisions for receiving a strap. In an exemplary embodiment, an arch member can include one or more slots for receiving a strap.

In some embodiments, arch member 980 can include one or more slots for receiving portions of strap 909. In some cases, medial arch member 926 can include first slot 991, second slot 992 and third slot 993. In some cases, lateral arch member 927 can include fourth slot 994, fifth slot 995 and sixth slot 996. Although the current embodiment includes six slots for arch member 980, in other embodiments any other number of slots could be used. For example, in another embodiment, medial arch member 926 could include two slots and lateral arch member 927 could include two slots.

Generally, the arrangement of one or more slots on arch member 980 could vary. In some cases, first slot 991 and second slot 992 of medial arch member 926 may be disposed near arch portion 115 of upper 102. Likewise, in some cases, fourth slot 994 and fifth slot 995 of lateral arch member 927 may be disposed near arch portion 115 of upper 102. This arrangement may provide for increased support at arch portion 115. Additionally, in some cases, third slot 993 of medial arch portion 926 and sixth slot 996 of lateral arch portion 927 may be disposed adjacent to heel portion 114 of upper 102. With this arrangement, a portion of strap 909 can be configured to wrap around heel portion 114 to provide enhanced support for the heel of the foot. By using multiple slots with arch member 980, strap 909 can be wrapped around upper 102 in various different locations to provide enhanced support for a foot.

Figure 13:
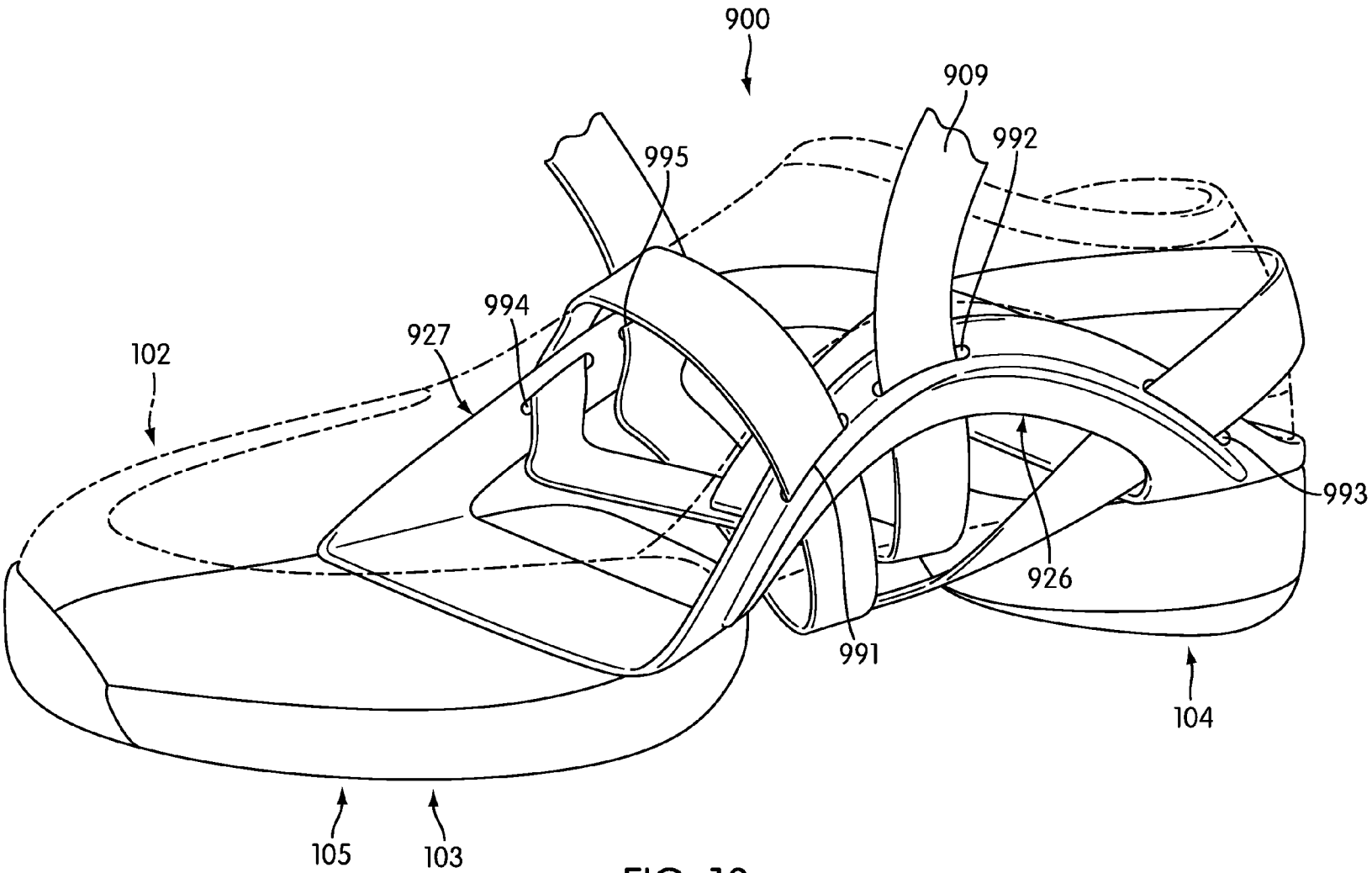
FIG. 13 is an isometric view of an embodiment of an article of footwear with an upper shown in phantom and with a strap in a loosened position.
Figure 14:
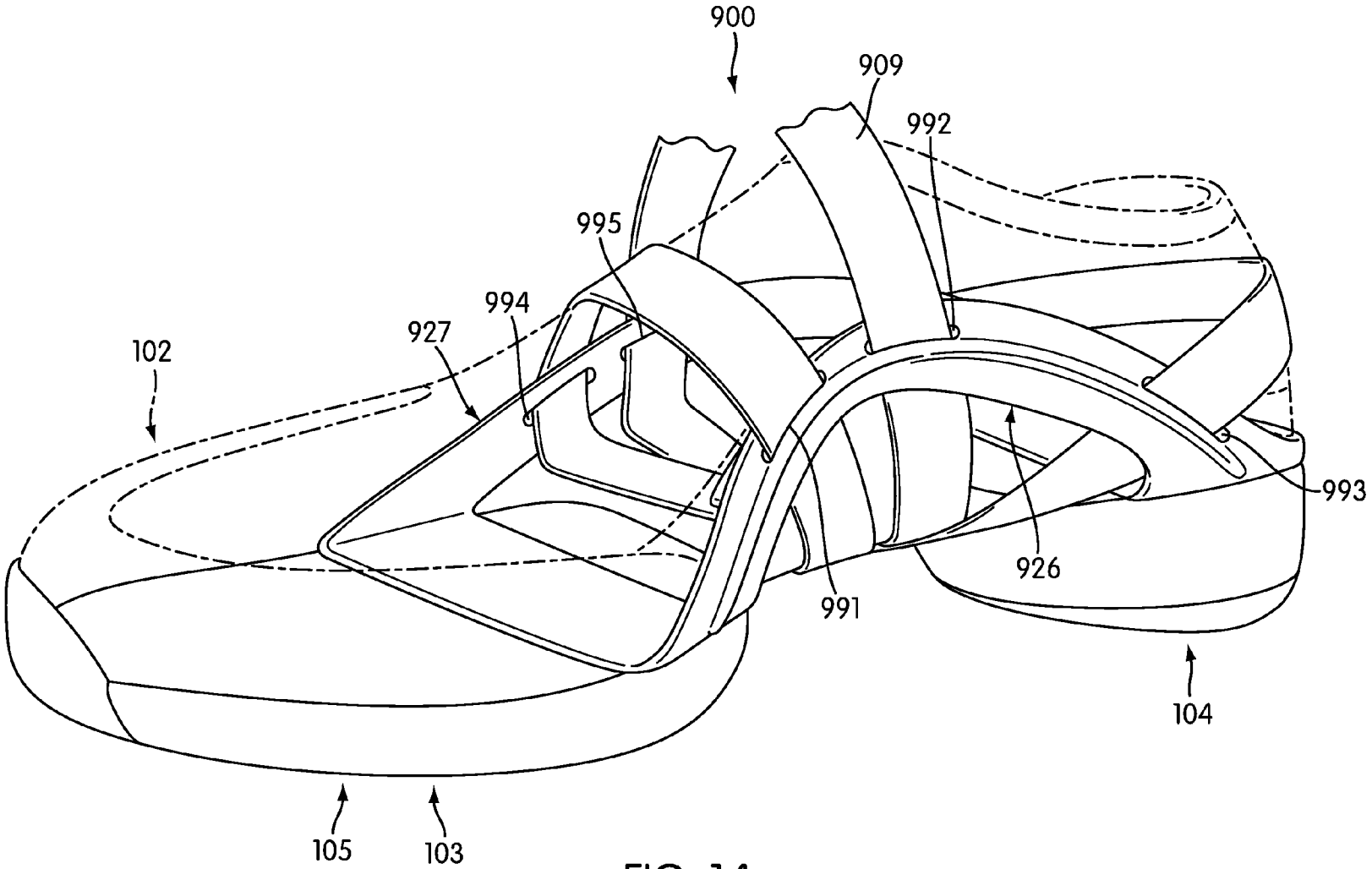
FIG. 14 is an isometric view of an embodiment of an article of footwear with an upper shown in phantom and with a strap in a tightened position.

FIGS. 13 and 14 are intended to illustrate an exemplary embodiment of article of footwear 900 moving between a loosened position and a tightened position. For purposes of illustration, upper 102 is shown in phantom in FIGS. 13 and 14. Referring to FIG. 13, article of footwear 900 is in a loosened position when strap 909 is loosened. By pulling strap 909 taught, as seen in FIG. 14, article of footwear 900 can be placed in a tightened position. Moreover, in the tightened position, medial arch member 926 is pulled against a medial side of upper 102 by portions of strap 909. Likewise, in the tightened position, lateral arch member 927 is pulled against a lateral side of upper 102 by portion of strap 909. With this arrangement, the sides of a foot may be supported by medial arch member 926 and lateral arch member 927. In some embodiments, a portion of strap 909 is also pulled against heel portion 114 of upper 102 as strap 909 is tightened. This provides enhanced support for the heel of the foot.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising: an upper including a toe portion, a heel portion opposite the toe portion, an arch portion disposed between the toe portion and the heel portion, a medial side, and a lateral side opposite the medial side; a sole comprising (a) a forefoot portion defined between a first forward free edge and a first rearward free edge opposite the first forward free edge and (b) a heel portion defined between a second forward free edge and a second rearward free edge opposite the second forward free edge, the first rearward free edge of the forefoot portion being spaced apart from the second forward free edge of the heel portion by a gap, the gap exposing the arch portion of the upper; an arch member including a lateral intermediate member disposed on the lateral side of the upper and a medial intermediate member disposed on the medial side of the upper, wherein the lateral intermediate member has a first lateral curved edge and an opposite second lateral curved edge both extending substantially parallel to one another to form an arcuate shape that extends from a first lateral end portion to a second lateral end portion opposite the first lateral end portion and the medial intermediate member has a first medial curved edge and an opposite second medial curved edge that both extend substantially parallel to one another to form an arcuate shape that extends from a first medial end portion to a second medial end portion opposite the first medial end portion;

wherein the first lateral end portion is connected to the first medial end portion by a first connecting member that extends from the medial side to the lateral side and is attached to the forefoot portion of the sole;

wherein the second lateral end portion is connected to the second medial end portion by a second connecting member that extends from the medial side to the lateral side, the second lateral end portion and the second medial end portion both terminating at the second connecting member at a point that is disposed closer to the second rearward free edge than the second forward free edge of the heel portion of the sole; and wherein the second connecting member is attached to the heel portion at the rearmost edge of the article of footwear.

2. The article of footwear according to claim 1, wherein the arch member is constructed of a rigid material.

3. The article of footwear according to claim 2, wherein the arch member is configured to deform.

4. The article of footwear according to claim 1, wherein the medial intermediate member is a mirror image of the lateral intermediate member.

5. The article of footwear according to claim 4, wherein the arch member is configured to hold the heel portion in suspension with respect to the forefoot portion.

6. An article of footwear, comprising: an upper having a lateral side and a medial side; a sole comprising a forefoot portion and a heel portion, the forefoot portion being spaced apart from the heel portion by a gap; an arch member including an intermediate member having a first curved edge and an opposite second curved edge both extending substantially parallel to one another to form an arcuate shape that extends from a first end portion to -a second end portion disposed opposite the first end portion; the first end portion being attached to the forefoot portion of the sole and the second end portion being attached to the heel portion; and wherein the intermediate member has an inner surface extending between the first curved edge and the second curved edge and facing one of the lateral side and the medial side of the upper and wherein the intermediate member is attached to the upper by only the first end portion and the second end portion such that the inner surface of the intermediate member disposed between the first end portion and the second end portion is spaced from the upper by a first gap allowing the entire portion of the intermediate member that is disposed between the first end portion and the second end portion to move independently of the upper;

wherein the intermediate member comprises a lateral intermediate member disposed on a lateral side of the upper and the first end portion is a first lateral end portion and the second end portion is a second lateral end portion and wherein the arch member includes a medial intermediate member disposed on a medial side of the upper, the medial intermediate member having a first medial end portion and a second medial end portion opposite the first medial end portion; and wherein the second lateral end portion of the lateral intermediate member and the second medial end portion of the medial intermediate member both terminate at a point that is disposed closer to a rearward free edge of the heel portion than a forward free edge of the heel portion that is opposite the rearward free edge.

7. The article of footwear according to claim 6, wherein the upper includes an ankle strap extending between the upper and the inner surface of the intermediate member.

8. The article of footwear according to claim 6, wherein the arch member is rigid and the intermediate member extends across the gap.

9. The article of footwear according to claim 8, wherein the first lateral end portion of the lateral intermediate member and the first medial end portion of the medial intermediate member are both attached to a rearward portion of the forefoot portion.

10. The article of footwear according to claim 6, wherein the medial intermediate member has an inner surface facing the medial side of the upper and at least a portion the inner surface of the medial intermediate member disposed between the first medial end portion and the second medial end portion is spaced from the upper by a second gap allowing the entire portion of the medial intermediate member that is disposed between the first medial end portion and the second medial end portion to move independently of the upper.

11. An article of footwear, comprising: an upper including a medial side and a lateral side opposite the medial side; a sole comprising a forefoot portion defined between a first forward free edge and a first rearward free edge opposite the first forward free edge and a heel portion defined between a second forward free edge and a second rearward free edge opposite the first forward free edge, the first rearward free edge of the forefoot portion being spaced apart from the second forward free edge of the heel portion by a gap; a rigid arch member including a lateral intermediate member disposed on the lateral side of the upper and a medial intermediate member disposed on the medial side of the upper, wherein the lateral intermediate member has a first lateral curved edge and an opposite second lateral curved edge both extending substantially parallel to one another to form an arcuate shape that extends from a first lateral end portion to a second lateral end portion opposite the first lateral end portion and the medial intermediate member has a first medial curved edge and an opposite second medial curved edge that both extend substantially parallel to one another to form an arcuate shape that extends from a first medial end portion to a second medial end portion opposite the first medial end portion;

wherein the lateral intermediate member has a lateral inner surface facing a medial inner surface of the medial intermediate member and the upper is disposed between the lateral inner surface and the medial inner surface; and wherein the first lateral end portion is connected to the first medial end portion by a forefoot connecting member that extends from the medial side to the lateral side and is attached to the forefoot portion of the sole, the forefoot connecting member having a first connecting free edge aligned with the first rearward free edge of the forefoot portion of the sole; wherein the second lateral end portion is connected to the second medial end portion by a rearward connecting member that extends from the medial side to the lateral side and is attached to the heel portion of the sole, the rearward connecting member being defined between a second connecting free edge and a third connecting free edge that is opposite the second connection free edge, the second connecting free edge being aligned with the second rearward free edge of the heel portion and the third connecting free edge being closer to the second rearward free edge than the second forward edge of the heel portion; and wherein the medial intermediate portion terminates at the second medial end portion and the lateral intermediate portion terminates at the second lateral end portion, the second medial end portion and the second lateral end portion both being disposed closer to the second rearward free edge than the second forward edge of the heel portion.

12. The article of footwear according to claim 11, wherein a distance between the first connecting free edge and the third connecting free edge decreases as the sole is moved between a substantially flat position and an en pointe position.

13. The article of footwear according to claim 11, wherein the second connecting free edge of the forefoot connecting member is straight and the second connecting free edge of the rearward connecting member is straight.

14. The article of footwear according to claim 13, wherein the rearward connecting member is disposed between the upper and the heel portion of the sole.

15. The article of footwear according to claim 11, wherein the lateral intermediate member has an inner surface extending between the first lateral curved surface to the second lateral curved surface and facing the lateral side of the upper and wherein the lateral intermediate member is attached to the upper by only the first end portion and the second end portion, wherein the entire portion of the inner surface of the lateral intermediate member disposed between the first lateral end portion and the second lateral end portion is spaced from the upper by a gap allowing the entire portion of the lateral intermediate member that is disposed between the first lateral end portion and the second lateral end portion to move independently of the upper.

16. The article of footwear according to claim 15, wherein the forefoot connecting member is disposed between the upper and the forefoot portion of the sole.

17. The article of footwear according to claim 11, wherein the lateral intermediate member and the medial intermediate member each have a slot for receiving a strap.

18. The article of footwear according to claim 17, further comprising a strap that extends through both the slot of the lateral intermediate member and the slot of the medial intermediate member to tighten the lateral intermediate member against the lateral side of the upper and the medial intermediate member against a medial side of the upper.

19. The article of footwear according to claim 17, wherein the slot of the lateral intermediate member is disposed opposite the slot of the medial intermediate member.

20. The article of footwear according to claim 17, wherein the slot of the lateral intermediate member and the slot of the medial intermediate member are both disposed adjacent to a heel portion of the upper and wherein the strap is configured to be inserted through the slot of the lateral intermediate member, around the heel portion, and through the slot of the medial intermediate member.

* * * * *